US006142433A

United States Patent [19]

Winger

[11] Patent Number: 6,142,433

[45] Date of Patent: Nov. 7, 2000

[54] WINDOW SASH HANGER

[75] Inventor: Timothy M. Winger, Lancaster, Pa.

[73] Assignee: Novelty Manufacturing Co., Lancaster, Pa.

[21] Appl. No.: 09/376,424

[22] Filed: Aug. 18, 1999

[51] Int. Cl.[7] ..... A47B 96/06; A47G 29/00; A47K 1/00; E04G 3/00; B42F 13/00

[52] U.S. Cl. ..... 248/214; 248/339

[58] Field of Search ..... 248/174, 208, 248/214, 339; 229/110, 109

[56] References Cited

U.S. PATENT DOCUMENTS

| | | | |
|---|---|---|---|
| 645,057 | 3/1900 | Ayers et al. | 248/339 |
| 2,286,118 | 6/1942 | Sleeth | 248/339 |
| 2,666,641 | 1/1954 | Bonham | 248/339 |
| 4,074,882 | 2/1978 | Anderson | 248/208 |
| 4,098,483 | 7/1978 | Pesola | 248/311.1 |
| 4,335,777 | 6/1982 | Simon | 248/339 |
| 4,887,785 | 12/1989 | Blaich | 248/339 |
| 4,896,456 | 1/1990 | Grant | 47/67 |
| 5,738,318 | 4/1998 | Grassi | 248/215 |
| 5,876,009 | 3/1999 | Simoncioni | 248/339 |

*Primary Examiner*—Anita M. King
*Assistant Examiner*—Jerome DeLuca
*Attorney, Agent, or Firm*—Martin Fruitman

[57] ABSTRACT

The apparatus is a hanger which is supported from the top of a window sash, door, railing, or similar support. The hanger is a box-like beam of relatively thin material which derives its strength from its four sided cross section. Aligned holes in both vertical sides near one end accept a hanging hook. The end opposite from the hole is sealed, and a thin end plane extends above the beam and has a right angle so that the plane extends from the beam in a direction parallel to the beam and away from the end with the hole. The extending portion of the plane has a section removed from the center, so that the extension actually becomes two separated fingers as it extends away from the beam. Installation only requires bending the extending fingers around the top of a window sash to form the end plane into an inverted "U" shape. Closing the window locks the hanger in place, and the bendable end plane allows the hanger to accommodate to any size sash.

5 Claims, 1 Drawing Sheet

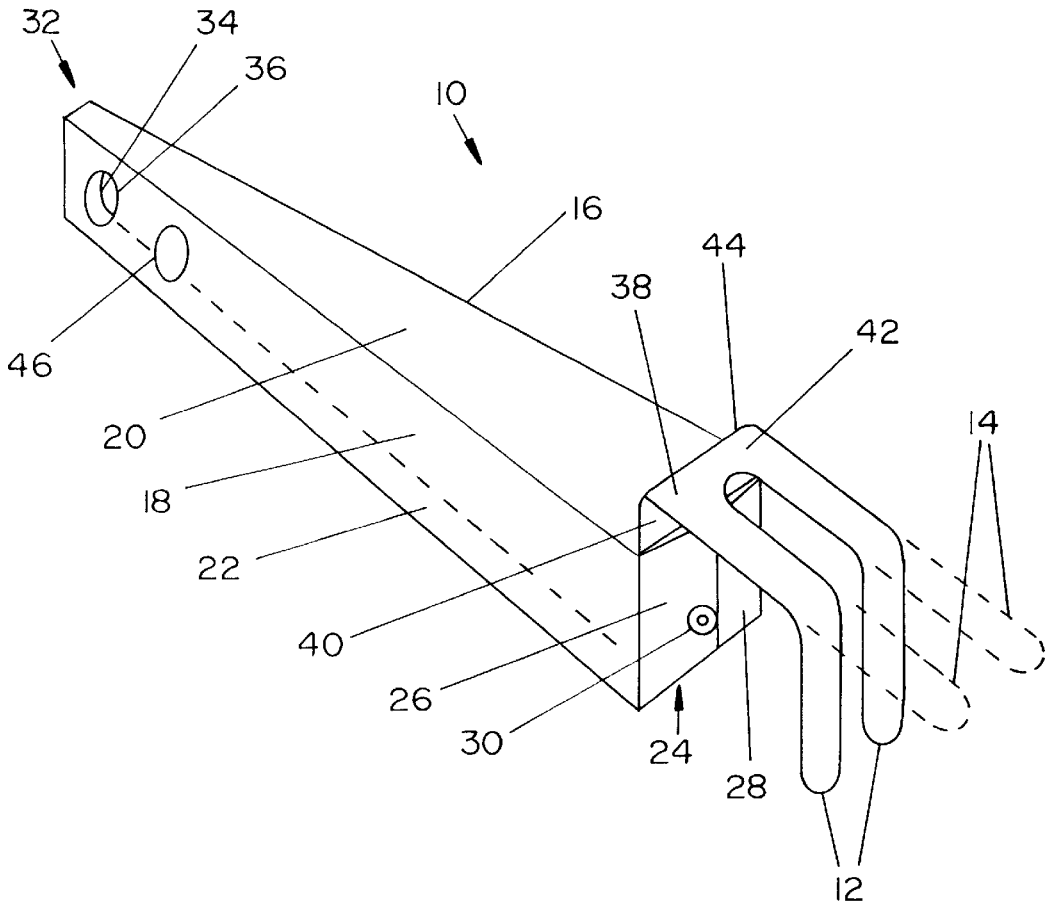
32
34
36
10
16
44
38
42
46
20
14
18
22
40
26
30
24
28
12

WINDOW SASH HANGER

BACKGROUND OF THE INVENTION

This invention deals generally with hangers and more specifically with a hanger which fits over the top of a window sash and is adjustable to accommodate varying thicknesses of window sashes.

The cultivation of indoor plants is a popular pastime, and since most plants require exposure to daylight it is very common to place plants near a window so they can benefit from the light shining through the window. While there are many plant hangers available to position plants high up and near windows, virtually all of them require some sort of installation with the use of tools. Typically, the minimum installation of such hangers involves the driving three or four screws into the window frame or wall above the window.

Such a procedure is not only time consuming, but it is beyond the capability of many people. Invariably it involves using a step ladder or the more dangerous alternative of standing on a chair or stool. Moreover, while the acknowledged proper method of installing screws is to predrill holes, even people who have drills rarely use them for the small job of installing four screws, and that usually leads to a slipping screwdriver and damaged walls, woodwork, or fingers. Installing screws in window frames and walls is also frowned upon by many landlords, and in many buildings the windows simply have no wood trim, which makes installation even more difficult.

It would be very beneficial to have a window hanger that needs no holes in the adjacent wall and does not require any tools for installation.

SUMMARY OF THE INVENTION

The present invention furnishes just such a window hanger. It requires no tools whatsoever to install, and the absence of screws within its package is not an oversight by the manufacturer. No screws, nails, glue, or any other fastening devices are needed for installation. The hanger is a single unit into which is integrated the only feature required for installation at windows.

The hanger is supported from the top of a window sash and held stably in place by the sash interlocking with the window frame. The hanger is a beam of relatively thin material which derives its strength from its four sided box-like cross section. Aligned holes in both vertical sides near one end are large enough to accept any hanging hook. The end opposite from the hole is covered, and a thin end plane is attached to and extends above the box beam and is bent at a right angle so that most of the end plane extends from the beam in a direction parallel to the beam and away from the end of the beam with the hole.

The extending portion of the end plane has a section removed from the center, so that the end plane actually becomes two separated fingers as it extends from the beam. Installation only requires bending the extending fingers around the top of a window sash to form the end plane into an inverted "U" shape. The width and thickness of the fingers are selected so that no tools are required to form them into the inverted "U" shape. Closing the window locks the hanger in place between the window sash and the window frame, and the bendable section of the end plane allows the hanger to accommodate to any size sash and even to be reformed for later use on another window.

The invention thereby furnishes a virtually ideal window hanger which can even be installed while standing at floor level. All that is required is to lower the upper sash of the typical double hung window, bend the extending fingers around the upper sash of the window, raise the upper sash back into place at the top of the frame, and lock the sashes together. The hanger can support relatively heavy indoor plants, and it can also easily be installed to hang outdoors by simply locating the beam on the outside of the window. Outdoors, the hanger can be used to support plants, banners, or bird feeders. Moreover, the hanger can also be used on many other support structures such as doors or deck railings.

BRIEF DESCRIPTION OF THE DRAWING

The FIGURE is a perspective view of the preferred embodiment of the invention.

DETAILED DESCRIPTION OF THE INVENTION

The FIGURE is a perspective view of the preferred embodiment of the invention in which hanger 10 is shown with fingers 12 already bent to conform with a typical window sash (not shown), and the original position of fingers 12 is shown with phantom lines 14.

The preferred embodiment of hanger 10 is actually constructed from a single piece of sheet stock. Thus, beam 16 is formed into an essentially rectangular cross section by simply folding its two sides 18 (one not seen) at approximate right angles to top 20, and its somewhat open bottom is formed by bending lips 22, shown by dashed lines, at approximate right angles to sides 18. Window end 24 of beam 16 is closed by bending flaps 26 and 28, which are actually extensions of sides 18, so that they meet. Flaps 26 and 28 are then held together by rivet 30. It should be clear from the geometry of hanger 10 that perfect right angles are not critical to the construction as long as the appropriate surfaces of beam 16 meet to form the final structure.

Hanger end 32, the end of beam 16 remote from fingers 14, can be left open, but when it is not closed it is strengthened by overlapping lips 22 which are folded from sides 18 and attached to each other. Thus, in the preferred embodiment, at hanger end 32 the cross section of beam 16 is a closed figure, but near finger end 24 the cross section of beam 16 actually has no bottom edge, and its strength is derived from joined flaps 26 and 28.

The basic function of hanger 10 is fulfilled by holes 34 and 36 which are formed in sides 18 near hanger end 32. Holes 34 and 36 are large enough to accommodate any conventional hanging hook (not shown), so that the hook can be hung through one or both of the holes.

Fingers 14 are attached to beam 16 because they are a part of end plane 38 from which they are formed by removing the material between them. End plane 38 is attached to beam 16 and is eventually shaped to hang from a support such as a window sash, the top of a door, or a deck railing.

In the preferred embodiment of the FIGURE, end plane 38 is actually an extension of top 20 simply bent at an approximate right angle to form vertical section 40 and then at another approximate right angle to form extension 42. This configuration is not arbitrary.

Hanger 10 is typically installed by placing extension 42 of end plane 38 over the top of a window sash so that it rests on the top surface of the window sash. Then, without tools, fingers 12 are easily bent down to be parallel to window end 24 of beam 16 and rest against the surface of the window sash opposite from the surface in contact with beam 16, thus forming end plane 38 into an inverted "U". Vertical section

40 is needed to locate beam 16 below the bottom of the top of a window frame so that hanger 10 can actually be locked into place by closing and locking the upper window sash into its normal location as it fits within the top of the window frame with the thin material of vertical section 40, extension 42, and fingers 12 wrapped around the upper sash.

End plane 38 is also designed to counteract the torque of a heavy plant hanging from hanger end 32 of beam 16. Thus, as the weight of the plant is applied to beam 16 and it attempts to rotate around corner 44 of end plane 38, vertical section 40 and flaps 26 and 28 which are held tightly against a window sash prevent any such rotation.

Furthermore, because hanger 10 is installed by bending the fingers from their original position 14 into their depicted position 12 which is against the backside of the window sash, the fingers prevent hanger 10 from falling even when the window is not locked in place. Such a structure therefore permits securely installing hanger 10 by shaping fingers 12 around the top sash of an upper window while the sash is lowered and before it is raised and locked into the window frame. It also permits the safe use of hanger 10 on the top of a lower sash of a double hung window, where fingers 12 are locked in place by being inserted between the lower sash of the upper window and the upper sash of the lower window.

An important feature of hanger 10 is its ability to be adjusted to various supporting structures. Since fingers 12 are constructed of thin, bendable material and located in a single plane, the user is easily able to bend the fingers to conform to the top of any size window sash.

In fact, although hanger 10 works best with double hung windows, it can also be used with hinged windows. Hanger 10 can also be used in locations other than at windows. For instance, hanger 10 can easily be installed on the top of a door, and, particularly with the inclusion of additional holes 46 along the length of beam 16, several clothes hangers can be hung from it.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, other attachment methods such as welds or chemical bonding agents can be substituted for rivet 30, and beam 16 need not have a particular cross section and can also be a solid structure with attached hooks. Moreover, beam 16 and end plane 38 can be independently constructed and later attached to each other, and hanger 10 can be constructed of various materials such as metal, plastic, or other sheet material.

What is claimed as new and for which Letters Patent of the United States are desired to be secured is:

1. A hanger comprising:

a box beam hanger structure with means for holding hanging hooks; and an end plane attached to one end of the hanger structure so that the hanger structure extends horizontally out of and away from the end plane, with the end plane including a bendable section which is of such width and thickness that the bendable section of the end plane can, without tools, be formed into an inverted "U" configuration, so that the inverted "U" can fit around a top edge of a support means with the hanger structure supported horizontally.

2. The hanger of claim 1 wherein the entire hanger is formed from a single sheet and the end plane is a continuation of a top surface of a beam formed by bending the single sheet.

3. The hanger of claim 1 wherein the means for hanging hooks is at least one hole in the hanger structure.

4. The hanger of claim 1 wherein the bendable section of the end plane is shaped as at least two fingers which are separated by a section removed from the end plane.

5. The hanger of claim 1 wherein the entire hanger is formed from a single sheet.

* * * * *